US011239543B2

(12) United States Patent
Lindmark

(10) Patent No.: US 11,239,543 B2
(45) Date of Patent: Feb. 1, 2022

(54) BASE STATION ANTENNAS HAVING PHASE-ERROR COMPENSATION AND RELATED METHODS OF OPERATION

(71) Applicant: CommScope Technologies LLC, Hickory, NC (US)

(72) Inventor: Björn Lindmark, Sollentuna (SE)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/909,588

(22) Filed: Jun. 23, 2020

(65) Prior Publication Data

US 2020/0411962 A1 Dec. 31, 2020

Related U.S. Application Data

(60) Provisional application No. 62/867,445, filed on Jun. 27, 2019.

(51) Int. Cl.

| | |
|---|---|
| ***H01Q 1/24*** | (2006.01) |
| ***H01Q 5/48*** | (2015.01) |
| ***H01Q 3/36*** | (2006.01) |
| ***H01Q 9/28*** | (2006.01) |
| ***H01Q 21/26*** | (2006.01) |

(52) U.S. Cl.

CPC ..... *H01Q 1/246* (2013.01); *H01Q 3/36* (2013.01); *H01Q 5/48* (2015.01); *H01Q 9/28* (2013.01); *H01Q 21/26* (2013.01)

(58) Field of Classification Search

CPC ..... H01Q 1/246; H01Q 5/48; H01Q 3/36; H01Q 9/28; H01Q 21/26; H01Q 5/40; H01Q 21/29; H01Q 21/06; H01Q 3/32; H01P 1/184

See application file for complete search history.

(56) References Cited

U.S. PATENT DOCUMENTS

| | | | | |
|---|---|---|---|---|
| 7,907,096 | B2 | 3/2011 | Timofeev et al. | |
| 9,614,664 | B2 * | 4/2017 | Morita | H04L 7/0016 |
| 9,972,893 | B2 * | 5/2018 | Patel | H01Q 3/40 |
| 10,270,159 | B1 * | 4/2019 | Bryce | H01Q 21/061 |

(Continued)

FOREIGN PATENT DOCUMENTS

| | | |
|---|---|---|
| CN | 102610919 A | 7/2012 |
| CN | 106921011 A | 7/2017 |

(Continued)

OTHER PUBLICATIONS

Notification of Transmittal of the International Search Report and the Written Opinion of the International Searching Authority, or the Declaration, in corresponding PCT Application No. PCT/US2020/039235 (dated Oct. 12, 2020).

*Primary Examiner* — Vibol Tan

(74) *Attorney, Agent, or Firm* — Myers Bigel, P.A.

(57) ABSTRACT

Base station antennas are provided herein. A base station antenna includes consecutive vertical columns of radiating elements. The base station antenna includes a phase shifter that is electrically connected to one of the vertical columns of radiating elements. Moreover, the base station antenna includes a phase-error compensation component that is configured to provide phase-error compensation at an input to the phase shifter based on movement of the phase-error compensation component. Related methods of operation are also provided.

20 Claims, 15 Drawing Sheets

(56) References Cited

U.S. PATENT DOCUMENTS

| | | | | |
|---|---|---|---|---|
| 10,601,120 | B2 | 3/2020 | Bisiules et al. | |
| 11,063,354 | B2 * | 7/2021 | Jan | H04B 7/0413 |
| 2018/0367199 | A1 | 12/2018 | Zimmerman | |

FOREIGN PATENT DOCUMENTS

| | | | |
|---|---|---|---|
| CN | 208111688 | U | 11/2018 |
| CN | 110661081 | A | 1/2020 |
| WO | 2017/165512 | A1 | 9/2017 |
| WO | 2019/212721 | A1 | 11/2019 |
| WO | 2020/013992 | A1 | 1/2020 |

* cited by examiner

BASE STATION ANTENNAS HAVING PHASE-ERROR COMPENSATION AND RELATED METHODS OF OPERATION

CROSS-REFERENCE TO RELATED APPLICATION

The present application claims priority to U.S. Provisional Patent Application No. 62/867,445, filed Jun. 27, 2019, the entire content of which is incorporated herein by reference.

FIELD

The present disclosure relates to communication systems and, in particular, to base station antennas.

BACKGROUND

Base station antennas for wireless communication systems are used to transmit Radio Frequency ("RF") signals to, and receive RF signals from, fixed and mobile users of a cellular communications service. Base station antennas often include a linear array or a two-dimensional array of radiating elements, such as crossed dipole or patch radiating elements.

Example base station antennas are discussed in International Publication No. WO 2017/165512 and U.S. patent application Ser. No. 15/921,694, the disclosures of which are hereby incorporated herein by reference in their entireties. A base station antenna that includes many closely-spaced radiating elements may present performance trade-offs for the antenna. For example, vertical columns of radiating elements that are horizontally closely-spaced may desirably provide wide scanning angles (e.g., an azimuth scan of up to about 60°) without grating lobes, but may also undesirably result in mutual coupling between the columns.

SUMMARY

A base station antenna, according to some embodiments herein, may include vertically staggered consecutive first, second, third, and fourth vertical columns of radiating elements that are configured to transmit RF signals in a frequency band. The base station antenna may include a phase shifter that is electrically connected to the first vertical column of radiating elements or the second vertical column of radiating elements. Moreover, the base station antenna may include a phase-error compensation component that is configured to provide phase-error compensation at an input to the phase shifter based on movement of the phase-error compensation component.

In some embodiments, the base station antenna may include a mechanical actuator that is configured to concurrently control the movement of the phase-error compensation component and movement of the phase shifter. Moreover, the phase shifter may be a rotational phase shifter, and the phase-error compensation component may be a dielectric structure on the rotational phase shifter. For example, the rotational phase shifter may be a wiper phase shifter, a rotatable portion of the wiper phase shifter may include a wiper Printed Circuit Board ("PCB"), and the dielectric structure may be between the wiper PCB and a main PCB of the wiper phase shifter. In some embodiments, the dielectric structure may be attached to the wiper PCB.

According to some embodiments, the phase shifter may be a non-rotational phase shifter. For example, the non-rotational phase shifter may be a trombone phase shifter or a sliding dielectric phase shifter.

In some embodiments, the phase shifter and the phase-error compensation component may be a first phase shifter and a first phase-error compensation component, respectively. Moreover, the base station antenna may include: a second phase shifter that is electrically connected to the third vertical column of radiating elements or the fourth vertical column of radiating elements; and a second phase-error compensation component that is configured to provide phase-error compensation at an input to the second phase shifter based on movement of the second phase-error compensation component.

According to some embodiments, the first and second phase shifters may be electrically connected to the first and third vertical columns of radiating elements, respectively. Moreover, the base station antenna may include third and fourth phase shifters that are electrically connected to the second and fourth vertical columns of radiating elements, respectively. Each of the third and fourth phase shifters may not include any movable phase-error compensation component.

Alternatively, the first and second phase shifters may be electrically connected to the second and fourth vertical columns of radiating elements, respectively, the base station antenna may include third and fourth phase shifters that are electrically connected to the first and third vertical columns of radiating elements, respectively, and each of the third and fourth phase shifters may not include any movable phase-error compensation component.

In some embodiments, the base station antenna may be configured to operate in a beam-forming mode. Moreover, the input to the phase shifter may include an input RF transmission line of the phase shifter, and a phase delay of phases traversing the input RF transmission line of the phase shifter may change as the phase-error compensation component moves relative to the input RF transmission line of the phase shifter.

A base station antenna, according to some embodiments herein, may include consecutive first, second, and third vertical columns of radiating elements that are configured to transmit RF signals in a beam-forming mode. The base station antenna may include a phase shifter that is electrically connected to the first vertical column of radiating elements or the second vertical column of radiating elements. Moreover, the base station antenna may include a phase-error compensation component that is configured to provide phase-error compensation at an input to the phase shifter based on movement of the phase-error compensation component.

In some embodiments, the second vertical column of radiating elements may be vertically staggered relative to the first and third vertical columns of radiating elements. Moreover, the base station antenna may include a fourth vertical column of radiating elements that is vertically staggered relative to the first and third vertical columns of radiating elements and is configured to transmit RF signals in the beam-forming mode. The fourth vertical column of radiating elements may be adjacent the first vertical column of radiating elements or the third vertical column of radiating elements.

According to some embodiments, the base station antenna may include a mechanical actuator that is configured to concurrently control the movement of the phase-error compensation component and movement of the phase shifter. The phase shifter may be configured to provide an amount of phase-error compensation at all outputs of the phase shifter in response to the phase-error compensation. Moreover, the phase-error compensation component may be a rotationally or translationally movable structure on the phase shifter, and the phase shifter may be a rotational phase shifter or a non-rotational phase shifter.

A method of operating a base station antenna, according to some embodiments herein, may include controlling an amount of phase shift and an amount of phase-error compensation for a vertical column of radiating elements by concurrently moving a phase shifter and a phase-error compensation component. For example, the controlling may be performed by a mechanical actuator of the base station antenna.

In some embodiments, the controlling may include providing the amount of phase-error compensation at all outputs of the phase shifter. The phase shifter, the vertical column of radiating elements, and the phase-error compensation component may include a first phase shifter, a first vertical column of radiating elements, and a first phase-error compensation component, respectively. The method may include controlling an amount of phase shift and an amount of phase-error compensation for a second vertical column of radiating elements by concurrently moving a second phase shifter and a second phase-error compensation component. The first and second vertical columns of radiating elements may be vertically staggered relative to an adjacent third vertical column of radiating elements and may be configured to transmit RF signals in a beam-forming frequency band. Moreover, the method may include controlling an amount of phase shift for the third vertical column of radiating elements by moving a third phase shifter while the third phase shifter does not include any movable phase-error compensation component.

DETAILED DESCRIPTION

Figure 1:
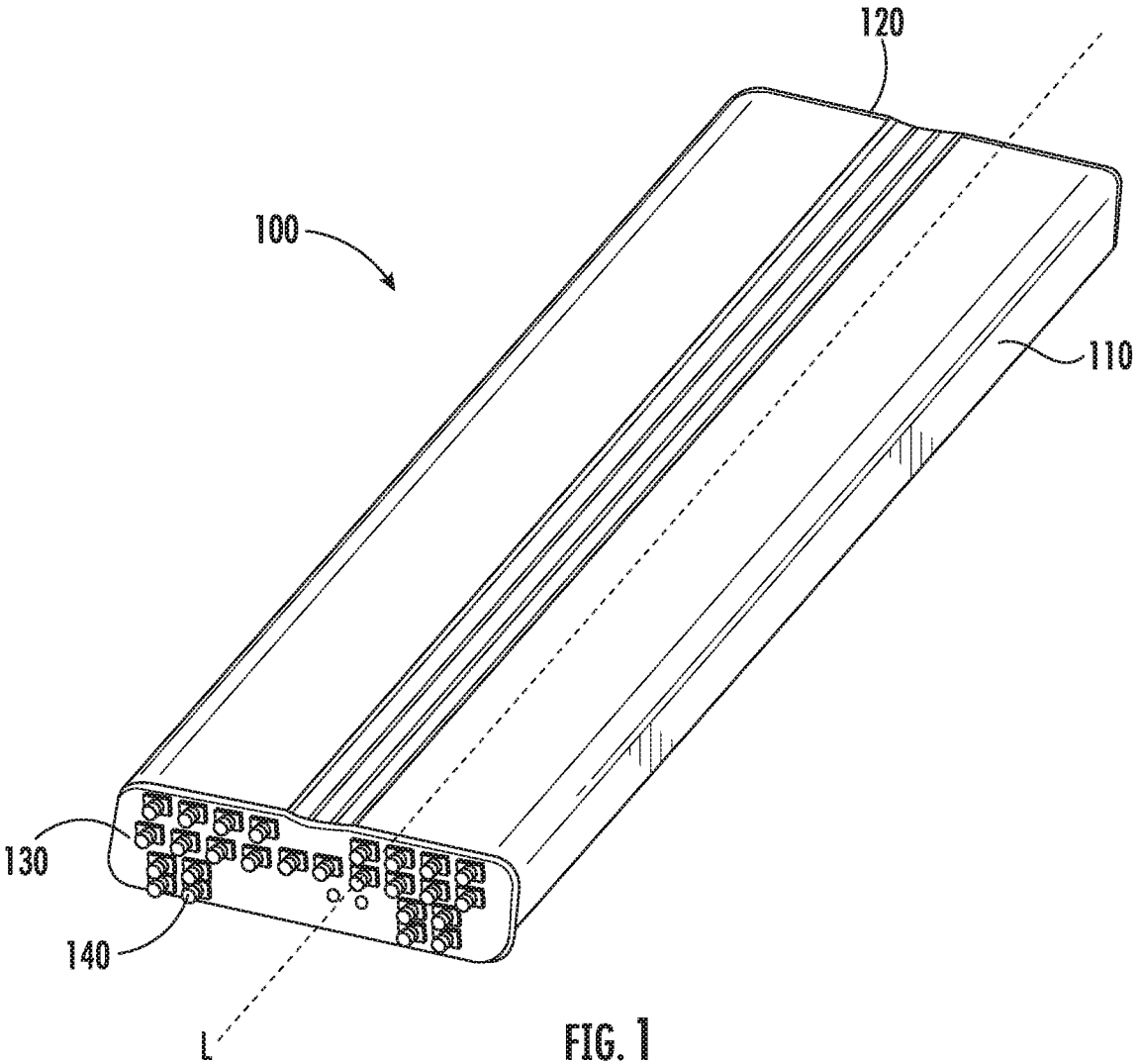
FIG. 1 is a front perspective view of a base station antenna according to embodiments of the present inventive concepts.

Pursuant to embodiments of the present inventive concepts, base station antennas for wireless communication networks are provided. In wireless communications, it may be desirable to use base station antennas having beam-forming arrays with multiple columns of radiating elements. A typical objective with such arrays is to create a narrow antenna beam in the azimuth plane. This increases the power of the signal transmitted in the direction of a desired user and reduces interference. It may also be desirable to electronically adjust the elevation angle of the antenna beam to adjust the coverage area of the antenna. This can be done for each column separately, such as by using electro-mechanical phase shifters.

To maintain a close spacing between adjacent columns while increasing the separation between radiating elements in adjacent columns, it may be desirable to vertically stagger adjacent columns. This staggered configuration reduces mutual coupling between neighboring elements, leading to increased port-to-port isolation.

Applying electrical down-tilt to a staggered array, however, may result in a phase error due to the staggering of the columns. This phase error will affect both the elevation pattern and, more importantly, the azimuth beam-forming pattern, which is where most of the performance gain in an antenna may occur. In particular, when scanning an antenna beam horizontally, a physical offset in the vertical direction between radiating elements in adjacent columns due to the staggering of the columns will cause the antenna beam to also scan in the vertical direction, thus providing an azimuth scan error. Accordingly, as electrical down-tilt is applied (e.g., adjusted), it may undesirably cause the phase error and impact the azimuth pattern.

Examples of electrical (i.e., electronic) down-tilt systems are discussed in International Application No. PCT/US2019/027274 and U.S. Patent Application No. 62/696,996, the disclosures of which are hereby incorporated herein by reference in their entireties. As discussed in these references, the boresight pointing direction of the antenna beam formed by a phased array of radiating elements may be electronically down-tilted to shift the pointing direction downward in the elevation plane. Moreover, a staggered configuration of columns will introduce a phase error. If the electrical down-tilt angle is a and the stagger is d/2, the phase error is $\beta_0=k(d/2)\sin\alpha$, where $k=2\pi/\lambda$ is the wave number, $\lambda$ is the wavelength, and d is the distance between adjacent radiators in a column. If the down-tilt angle $\alpha$ is known, this phase error can be compensated for by the system (e.g., by a base station). It is not certain, however, that the system's beam-forming software and down-tilt control are the same, so compensation using a known down-tilt angle may not always be possible.

According to embodiments of the present inventive concepts, however, phase compensation (e.g., phase delay) may be added/adjusted at the input of a phase shifter to compensate for the phase error that is introduced when the antenna beam is electrically down-tilted. For example, the amount of phase compensation may be controlled by the same mechanical actuator movement that controls the phase shift between the radiating elements (or sub-arrays of the radiating elements) of the antenna column that is coupled (e.g., electrically connected) to the phase shifter.

If the phase shifter is a rotational device, such as a wiper-arc phase shifter, phase compensation can be implemented with a dielectric body (i.e., dielectric structure) that separates the wiper arm of the phase shifter from the arc of the phase shifter. When the dielectric body and the wiper arm move (i.e., rotate), phase shifts may be created between output ports of the phase shifter, and these phase shifts provide the electrical down-tilt. In some embodiments, the dielectric body may be shaped such that a portion of it will move onto, or underneath, an input line of the phase shifter, thereby creating a phase delay that can compensate for the staggering of the columns.

Moreover, a trombone line may, in some embodiments, be used instead of the rotating dielectric body, to provide even greater phase compensation. If the phase shifter is a device using a translational movement, similar phase shift compensation can be achieved using variants of either of the dielectric body or the trombone line.

Example embodiments of the present inventive concepts will be described in greater detail with reference to the attached figures.

FIG. 1 is a front perspective view of a base station antenna 100 according to embodiments of the present inventive concepts. As shown in FIG. 1, the base station antenna 100 is an elongated structure and has a generally rectangular shape. The base station antenna 100 includes a radome 110. In some embodiments, the base station antenna 100 further includes a top end cap 120 and/or a bottom end cap 130. For example, the radome 110, in combination with the top end cap 120, may comprise a single unit, which may be helpful for waterproofing the base station antenna 100. The bottom end cap 130 is usually a separate piece and may include a plurality of connectors 140 mounted therein. The connectors 140 are not limited, however, to being located on the bottom end cap 130. Rather, one or more of the connectors 140 may be provided on the rear (i.e., back) side of the radome 110 that is opposite the front side of the radome 110. The base station antenna 100 is typically mounted in a vertical configuration (i.e., the long side of the base station antenna 100 extends along a vertical axis L with respect to Earth).

Figure 2A:
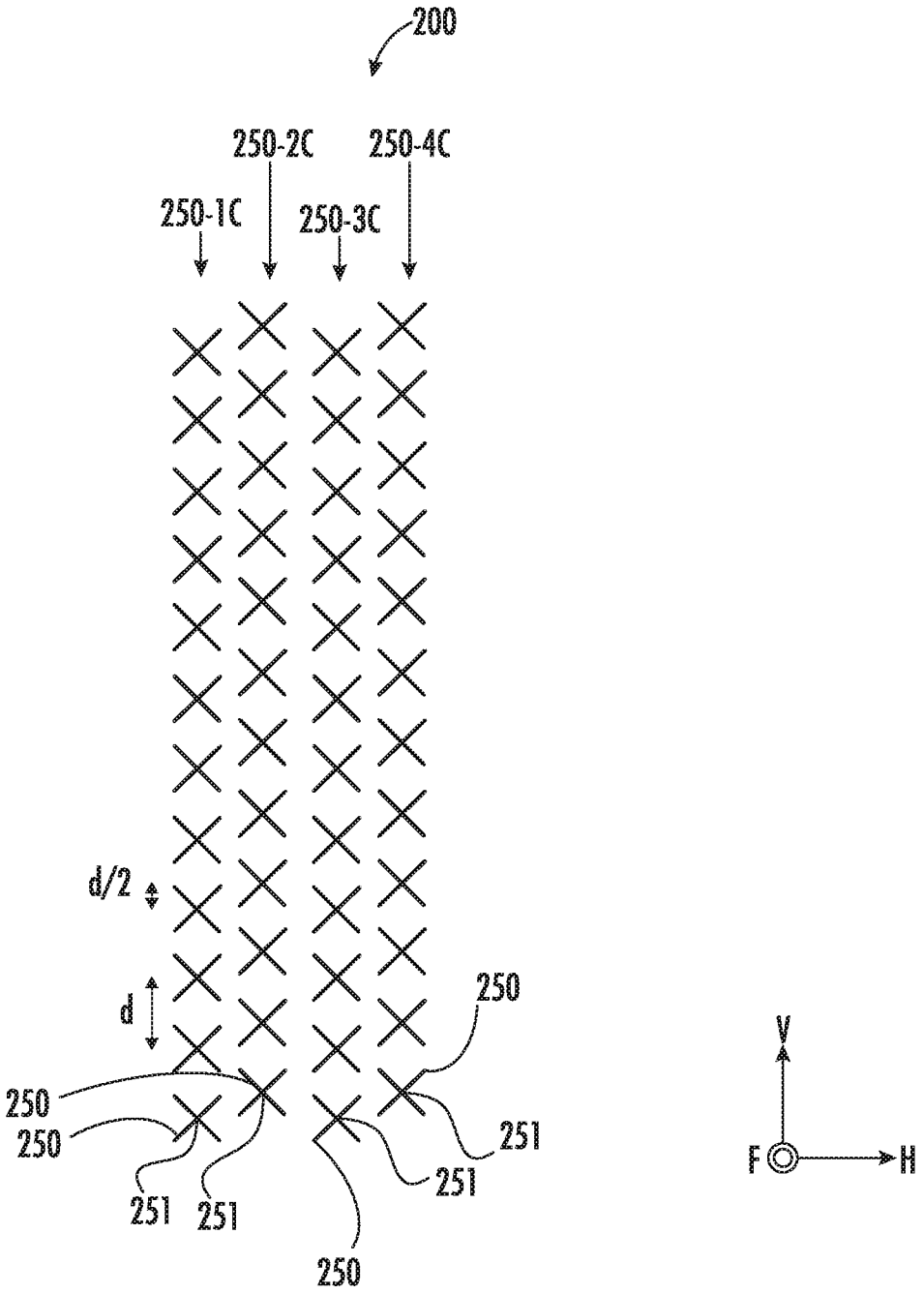
FIG. 2A is a schematic front vie of the base station antenna of FIG. 1 with the radome removed.

FIG. 2A is a schematic front view of the base station antenna 100 of FIG. 1 with the radome 110 thereof removed to illustrate an antenna assembly 200 of the antenna 100. The antenna assembly 200 includes a plurality of radiating elements 250, which may be grouped into one or more arrays, including one or more beam-forming arrays.

Vertical columns 250-1C through 250-4C of the radiating elements 250 may extend in a vertical direction V from a lower portion of the antenna assembly 200 to an upper portion of the antenna assembly 200. The vertical direction V may be, or may be in parallel with, the longitudinal axis L (FIG. 1). The vertical direction V may also be perpendicular to a horizontal direction H and a forward direction F. As used herein, the term "vertical" does not necessarily require that something is exactly vertical (e.g., the antenna 100 may have a small mechanical down-tilt). The radiating elements 250 may extend forward in the forward direction F from one or more feeding (or "feed") boards 204 (FIG. 2B) that couple RF signals to and from the individual radiating elements 250. For example, the radiating elements 250 may, in some embodiments, be on the same feeding board 204. As an example, the feeding board 204 may be a single PCB having all of the radiating elements 250 thereon. Cables may be used to connect each feeding board 204 to other components of the antenna 100, such as diplexers, phase shifters, or the like.

As shown in FIG. 2A, the vertical columns 250-1C through 250-4C may have a staggered arrangement. In particular, consecutive ones of the vertical columns 250-1C through 250-4C may be vertically staggered relative to each other. For example, center points 251 of the vertical column 250-1C may be staggered relative to corresponding center points 251 of the vertical column 250-2C in the vertical direction V. Also, the center points 251 of the vertical column 250-2C may be vertically staggered relative to corresponding center points 251 of the vertical column 250-3C, which may also be vertically staggered relative to corresponding center points 251 of the vertical column 250-4C. Center points 251 of radiating elements 250 in a vertical column may be spaced apart from each other in the vertical direction V by a distance d, and the amount of stagger in the vertical direction V between consecutive ones of the vertical columns 250-1C through 250-4C may be about d/2. The staggered arrangement shown in FIG. 2A may reduce mutual coupling between radiating elements 250 in neighboring (i.e., consecutive) ones of the vertical columns 250-1C through 250-4C. As a result, port-to-port isolation may increase (because each column is fed by a different port or ports than other columns).

In some embodiments, non-consecutive ones of the vertical columns 250-1C through 250-4C may not be vertically staggered relative to each other. For example, center points 251 of the vertical column 250-1C may be aligned with corresponding center points 251 of the vertical column 250-3C in the horizontal direction H. Similarly, center points 251 of the vertical column 250-2C may be aligned with corresponding center points 251 of the vertical column 250-4C in the horizontal direction H. As used herein, the term "vertical" (or "vertically") refers to something (e.g., a distance, axis, or column) in the vertical direction V. Moreover, a feed point may, in some embodiments, be at or adjacent the center point 251 of a radiating element 250.

Though FIG. 2A illustrates the four vertical columns 250-1C through 250-4C, the antenna assembly 200 may include more (e.g., five, six, or more) or fewer (e.g., two or three) vertical columns of the radiating elements 250. Moreover, the number of radiating elements 250 in a vertical column can be any quantity from two to twenty or more. For example, the vertical columns 250-1C through 250-4C may each have twelve to twenty radiating elements 250.

In some embodiments, the antenna assembly 200 may include a plurality of radiating elements (not shown) that are configured to operate in a frequency band different from that of the radiating elements 250. For example, the vertical columns 250-1C through 250-4C may be "inner" vertical columns of high-band radiating elements that are between, in the horizontal direction H, vertical columns of low-band radiating elements. Moreover, the radiating elements 250, and/or other (e.g., low-band) radiating elements of the antenna assembly 200, may comprise dual-polarized radiating elements that are mounted to extend forwardly in the forward direction F from the feeding board(s) 204.

The radiating elements 250 may, in some embodiments, be high-band radiating elements that are configured to transmit and receive signals in a high frequency band comprising one of the 1400-2700 MHz, 3300-4200 MHz, and/or 5000-5900 MHz frequency ranges or a portion thereof. By contrast, low-band radiating elements may be configured to transmit and receive signals in a low frequency band comprising the 617-960 MHz frequency range or a portion thereof.

In some embodiments, the radiating elements 250 may be used in a beam-forming mode to transmit RF signals where the antenna beam is "steered" in at least one direction. Examples of antennas that may be used as beam-forming antennas are discussed in U.S. Patent Publication No. 2018/0367199, the disclosure of which is hereby incorporated herein by reference in its entirety. For example, a base station may include a beam-forming radio that has a plurality of output ports that are electrically connected to respective ports of a base station antenna.

Figure 2B:
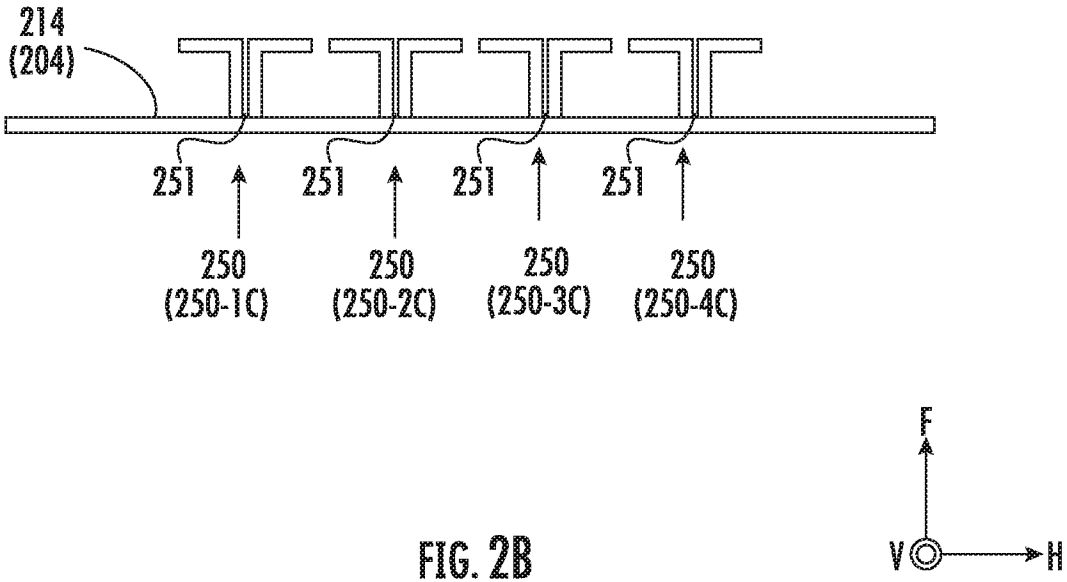
FIG. 2B is a schematic profile view of the radiating elements of FIG. 2A.

FIG. 2B is a schematic profile view of the radiating elements 250 of FIG. 2A. The profile view shows a "row" of the radiating elements 250 along the horizontal direction H. The row includes a first radiating element 250 in the vertical column 250-1C, a second radiating element 250 in the vertical column 250-2C, a third radiating element 250 in the vertical column 250-3C, and a fourth radiating element 250 in the vertical column 250-4C. As the vertical columns 250-1C through 250-4C are vertically staggered, no more than two of the radiating elements 250 in the row are aligned with each other in the horizontal direction H.

As shown in FIG. 2B, the radiating elements 250 may extend in the forward direction F from a ground plane reflector 214. The feeding boards 204 may be located forward or rearward of the reflector 214.

Various mechanical and electronic components of the antenna 100 (FIG. 1) may be mounted in a chamber behind a back side of the reflector surface 214. The components may include, for example, phase shifters, remote electronic tilt units, mechanical linkages, a controller, diplexers, and the like. The reflector surface 214 may comprise a metallic surface that serves as a reflector and ground plane for the radiating elements 250 of the antenna 100. Herein, the reflector surface 214 may also be referred to as the reflector 214.

Figure 2C:
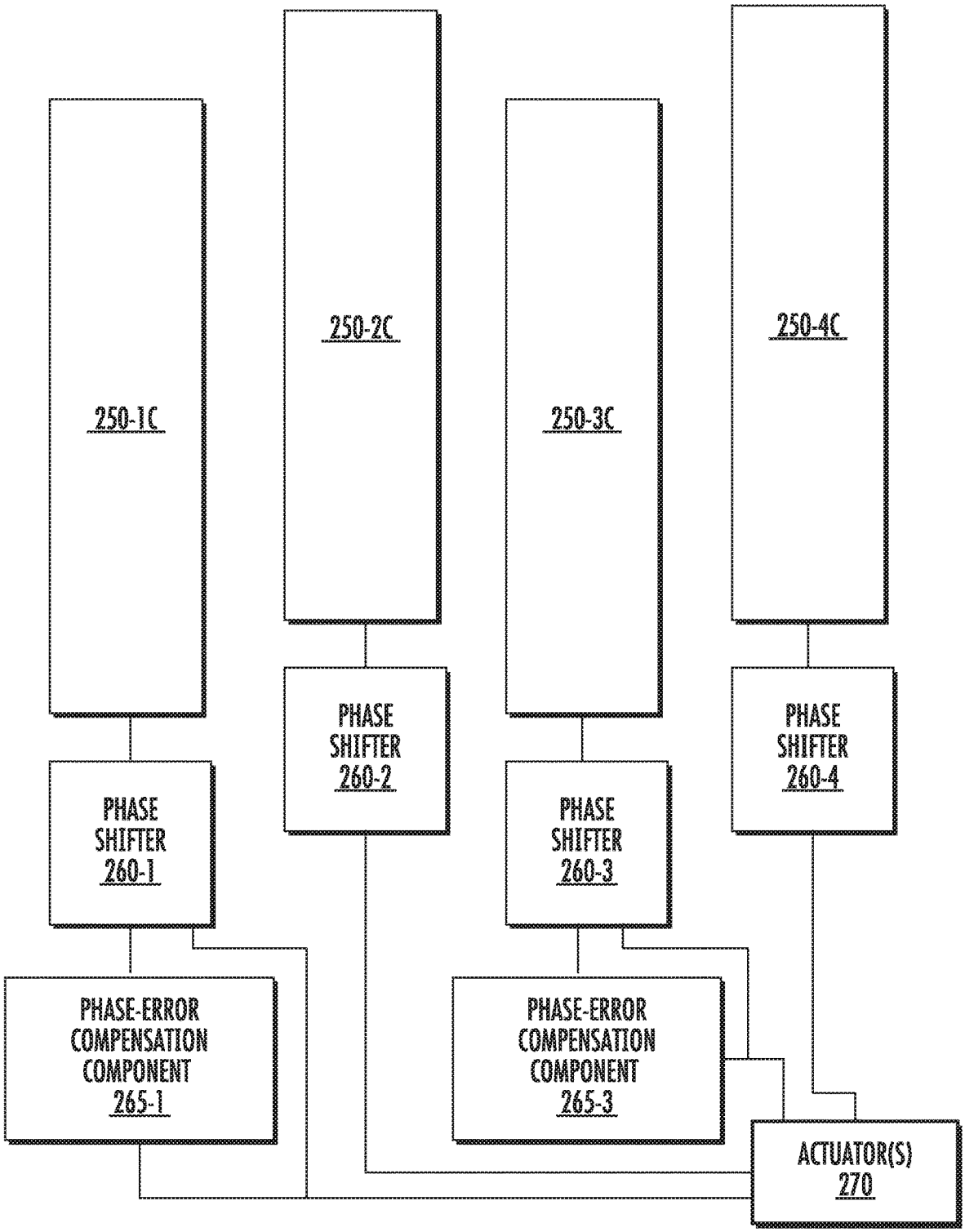
FIGS. 2C and 2D are schematic block diagrams of the vertical columns of FIG. 2A electrically connected to phase shifters.
Figure 2D:
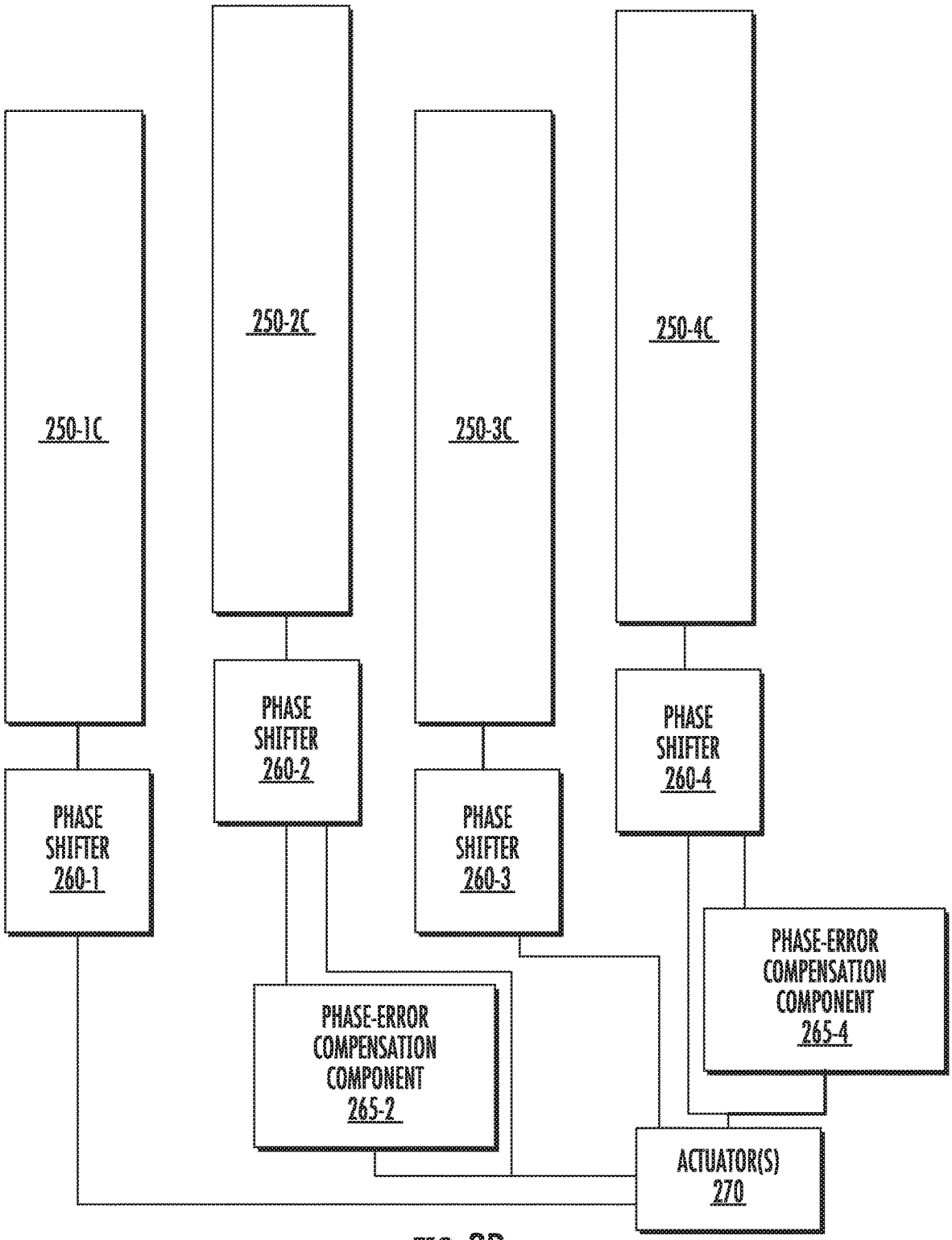

FIGS. 2C and 2D are schematic block diagrams of the vertical columns 250-1C through 250-4C of FIG. 2A electrically connected to phase shifters 260. The phase shifters 260 may be rotational (e.g., wiper) phase shifters or non-rotational (e.g., trombone or sliding dielectric) phase shifters. One or more mechanical (e.g., electro-mechanical) actuators 270 may control movement of the phase shifters 260. The actuator(s) 270 may also control movement of one or more phase-error compensation components 265. In particular, the same mechanical movement by an actuator 270 may control both (i) phase shifts and (ii) an amount of phase compensation (to adjust the delay of phases traversing the input RF transmission line to compensate for the phase error caused by the vertical stagger).

In some embodiments, a phase-error compensation component 265 that is movable (e.g., rotationally or translationally movable) may add phase-error compensation by providing phase-error compensation at an input to a phase shifter 260 based on movement of the phase-error compensation component 265. For example, movement of a phase-error compensation component 265-1 may be used to change the relative phase of the RF signal that is input to a phase shifter 260-1 that is electrically connected to the vertical column 250-1C. Phase-error compensation components 265-2, 265-3, and/or 265-4 may similarly be used to change the relative phase of the RF signals that are input to phase shifters 260-2, 260-3, and 260-4, respectively, to add phase-error compensation, Though vertically staggering the vertical columns 250-1C through 250-4C can result in a phase error when applying electrical down-tilt, the use of one or more phase-error compensation components 265 can mitigate the phase error. As the phase error may be substantially absent in odd-numbered or even-numbered ones (e.g., in half) of the vertical columns 250-1C through 250-4C, corresponding ones of the phase shifters 260 may not include any phase-error compensation component 265. For example, as shown in FIG. 2C, the phase-error compensation components 265-1 and 265-3 may add phase-error compensation to the phase shifters 260-1 and 260-3, respectively, and the phase shifters 260-2 and 260-4 may not include any phase-error compensation component 265. As another example, as shown in FIG. 2D, the phase-error compensation components 265-2 and 265-4 may add phase-error compensation to the phase shifters 260-2 and 260-4, respectively, and the phase shifters 260-1 and 260-3 may not include any phase-error compensation component 265. The level of compensation achieved by using phase-error compensation components 265 with one or two (e.g., about half) of the phase shifters 260 may be such that it may not be necessary to add phase-error compensation for every phase shifter 260.

In some embodiments, all four of the vertical columns 250-1C through 250-4C may be phase-error compensated by respective phase-error compensation components 265-1 through 265-4. Accordingly, the phase-error compensation components 265-1 and 265-3 (FIG. 2C) and the phase-error compensation components 265-2 and 265-4 (FIG. 2D) may be used collaboratively (e.g., concurrently). For example, the phase-error compensation components 265-1 and 265-3 may operate in a different rotational or translational direction from the phase-error compensation components 265-2 and 265-4, thus reducing the amount of phase-error compensation demanded of individual ones of the phase-error compensation components 265-1 through 265-4.

Figure 2E:
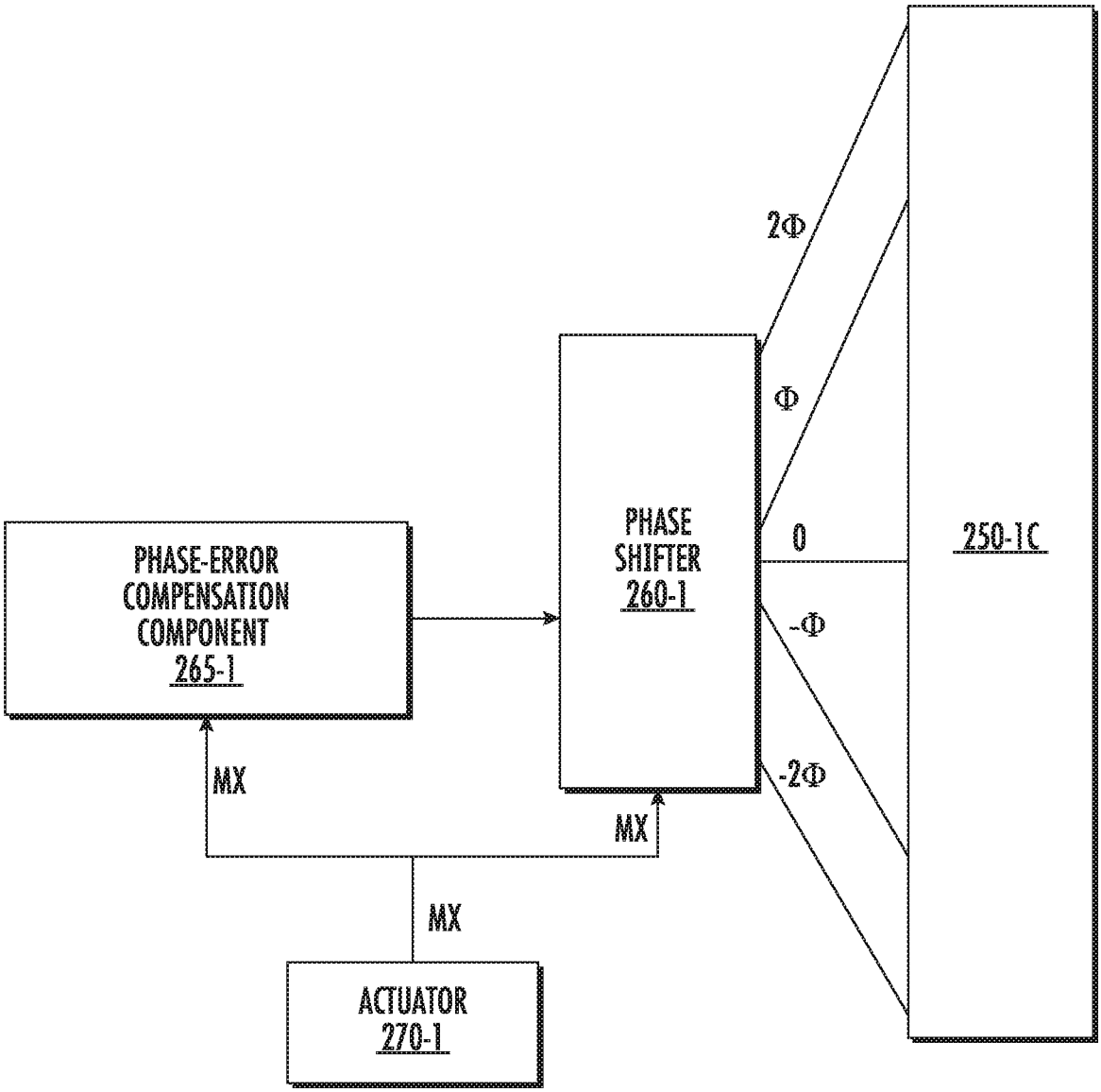
FIGS. 2E and 2F are schematic block diagrams illustrating details of a phase-error compensation scheme for one of the vertical columns of FIG. 2C.
Figure 2F:
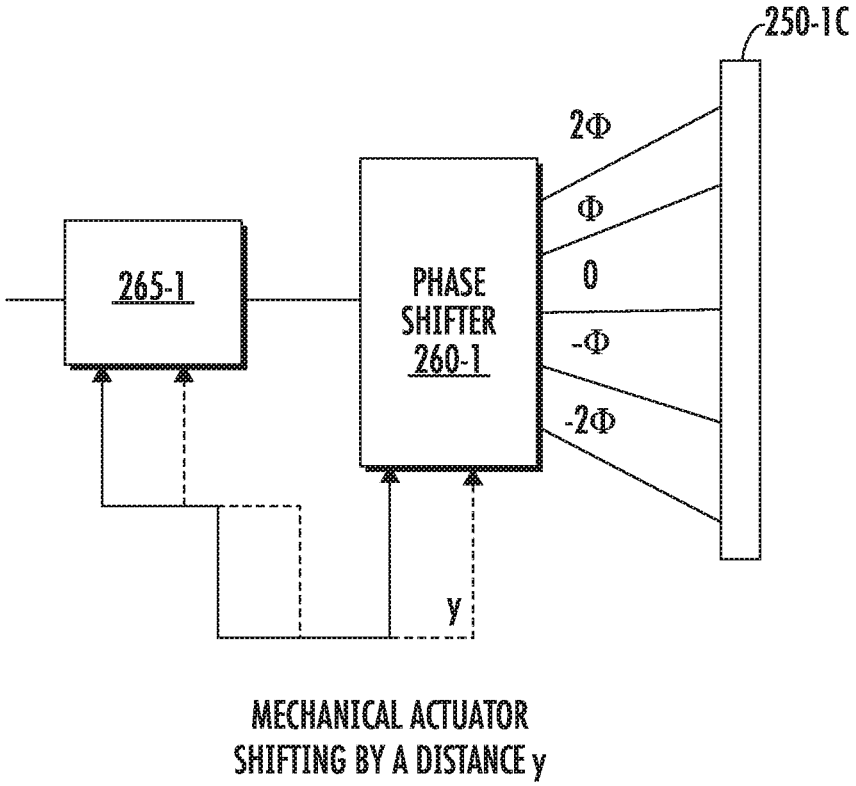

FIGS. 2E and 2F are schematic block diagrams illustrating details of a phase-error compensation scheme for one of the vertical columns 250-1C through 250-4C of FIG. 2C. Though column 250-1C is used as an example, a similar scheme may be used with any of the columns 250-4C through 250-4C of FIGS. 2C/2D. In addition to controlling the phase shifts (e.g., $2\varphi$, $\varphi$, $-\varphi$, $-2\varphi$) by the phase shifter 260-1, an actuator 270-1 controls an amount of phase-error compensation via the phase shifter 260-1 to mitigate a phase error that results from vertically staggering the columns 250-1C through 250-4C.

As shown in FIG. 2E, the actuator 270-1 is mechanically coupled (e.g., by one or more mechanical linkages) to both the phase shifter 260-1 and the phase-error compensation component 265-1. In particular, FIG. 2E shows that a movement MX by the actuator 270-1 is applied to both the phase shifter 260-1, which may be a multi-port phase shifter, and the phase-error compensation component 265-1, which may responsively adjust the phase of the RF signal input to the phase shifter 260-1. Relative phase shifts (e.g., $2\varphi$, $\varphi$, $-\varphi$, $-2\varphi$) by the phase shifter 260-1 are applied by the movement MX to provide an electrical down-tilt.

As a result of the movement MX, the phase shifter 260-1 may apply a phase taper to sub-components of an RF signal that are transmitted through respective radiating elements 250 (or sub-groups of radiating elements 250). The phase taper may be applied by applying positive phase shifts of various magnitudes (e.g., $+\varphi°$ and $+2\varphi°$) to some of the sub-components of the RF signal and by applying negative phase shifts of the same magnitudes (e.g., $-\varphi°$ and $-2\varphi°$) to additional of the sub-components of the RF signal.

As shown in FIG. 2F, the actuator 270-1, which is omitted from view for simplicity, moves a movable member of the phase shifter 260-1 by a distance of y. This movement by the actuator 270-1 also moves the phase-error compensation component 265-1.

Figure 3A:
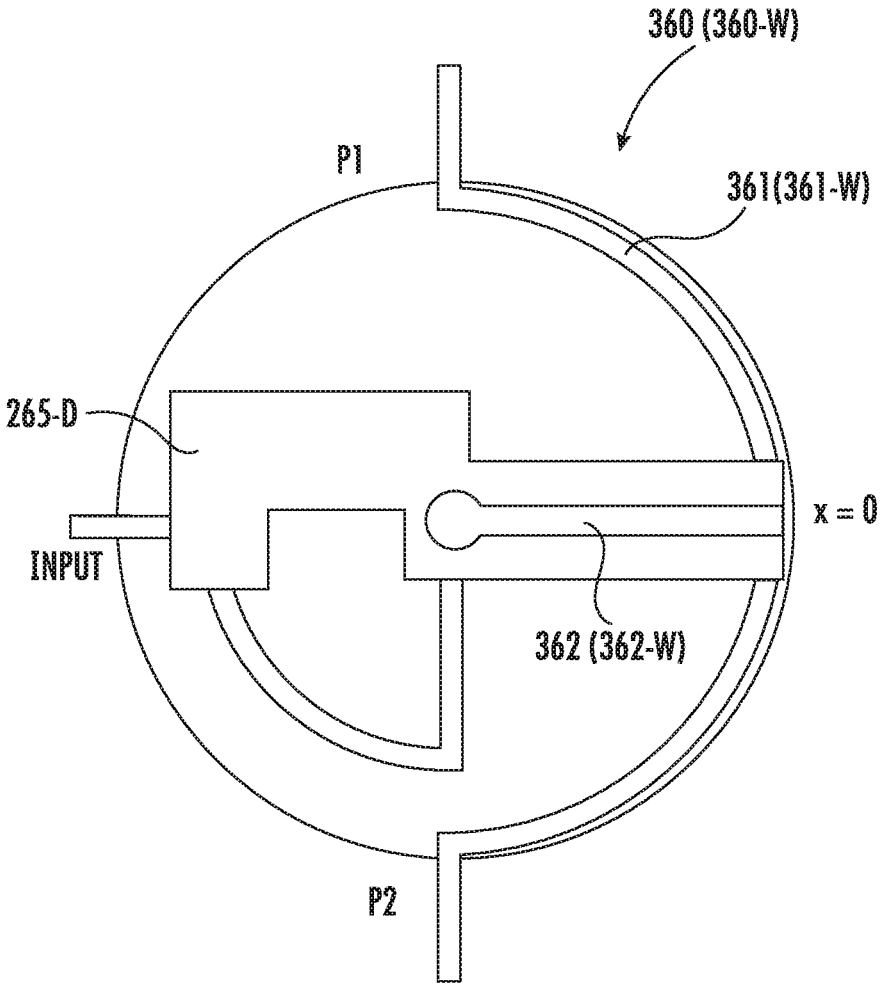
FIGS. 3A and 3B are schematic plan views of a rotational phase shifter having phase-error compensation, according to embodiments of the present inventive concepts.
Figure 3B:
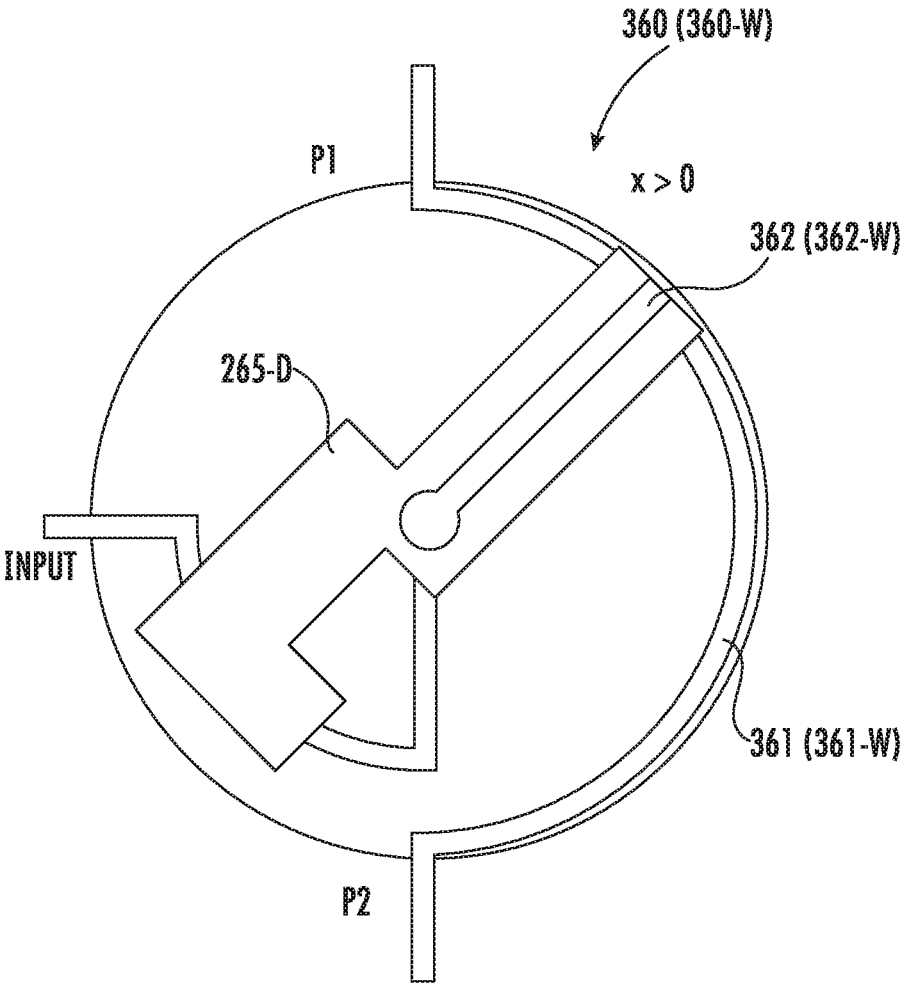

FIGS. 3A and 3B are schematic plan views of a rotational phase shifter 360 having phase-error compensation, according to embodiments of the present inventive concepts. An actuator 270 (FIGS. 2C-2E) controls an angle x that is common to both the rotational phase shifter 360 and a phase-error compensation component 265 (FIGS. 2C-2F). In particular, the rotational phase shifter 360 is shown as a wiper phase shifter 360-W that includes a wiper arm that rotates from an angle of x equals zero (FIG. 3A) to an angle of x that is greater than zero (FIG. 3B). For example, the rotational phase shifter 360 may include a stationary portion 361 (e.g., a main PCB 361-W having an RF transmission line thereon) and a rotatable portion 362 (e.g., a wiper PCB 362-W). When the actuator 270 applies a rotational movement to the rotational phase shifter 360, a dielectric structure 265-D also rotates above (or below) the input RF transmission line for the rotational phase shifter 360. The rotation of the dielectric structure 265-D changes the phase delay of phases traversing the input RF transmission line to compensate for the phase error caused by the vertical stagger. The dielectric structure 265-D is thus one example of a phase-error compensation component 265.

The shape of the rotational dielectric structure 265-D is not limited to the shape shown in the example of FIGS. 3A and 3B. Rather, in some embodiments, the shape of the dielectric structure 265-D may be extended (e.g., with a curved/triangle-shaped extension portion) beyond the shape shown in the example of FIGS. 3A and 3B. As a result, such a larger/extended dielectric structure 265-D may rotate to be completely over the input line so that phase-error compensation may reach a maximum before the phase shifter 360 reaches its maximum position.

Figure 3C:
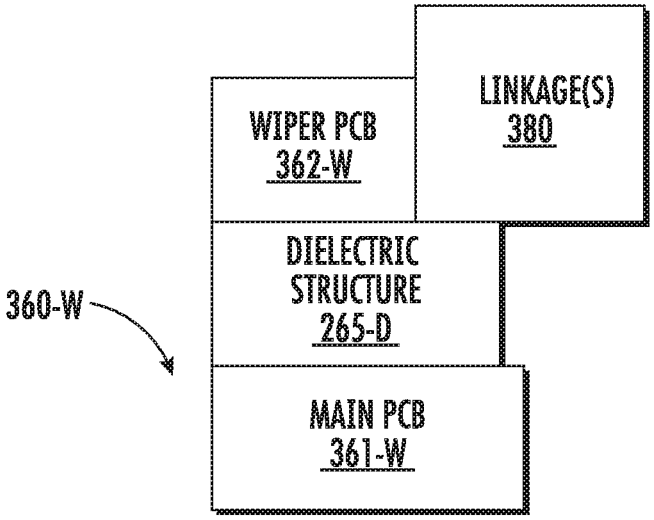
FIG. 3C is a schematic cross-sectional view of a wiper phase shifter having phase-error compensation, according to embodiments of the present inventive concepts.

FIG. 3C is a schematic cross-sectional view of a wiper phase shifter 360-W having phase-error compensation, according to embodiments of the present inventive concepts. The wiper phase shifter 360-W includes a rotatable wiper PCB 362-W and a stationary main PCB 361-W. When the dielectric structure 265-D and the wiper PCB 362-W move to an angle of x that is greater than zero (FIG. 3B), a positive phase shift is created between the ports P1 and P2 (FIG. 3B) of the wiper phase shifter 360-W, corresponding to electrical down-tilt.

The dielectric structure 265-D may be attached to the wiper PCB 362-W, and thus may rotate because the rotatable wiper PCB 362-W rotates. Alternatively, the dielectric structure 265-D may rotate independently of the wiper PCB 362-W. For example, an actuator 270 may control rotational movement of the dielectric structure 265-D and the wiper PCB 362-W via respective mechanical linkages 380. Moreover, in some embodiments, the dielectric structure 265-D may be between the wiper PCB 362-W and the main PCB 361-W.

The wiper PCB 362-W is typically moved using an actuator 270 that includes a Direct Current ("DC") motor that is connected to the wiper PCB 362-W via a mechanical linkage 380. Such actuators are often referred to as "RET" actuators because they are used to apply remote electronic down tilt. Example phase shifters, actuators, and linkages of this variety are discussed in U.S. Patent Application No. 62/696,996, U.S. Pat. No. 7,907,096, and Chinese Patent Application No. 201810692241.5, the disclosures of which are hereby incorporated herein by reference in their entireties.

Though FIGS. 3A-3C illustrate a wiper phase shifter 360-W, a phase shifter 260 (FIGS. 2C-2F) may instead be a non-rotational phase shifter 365 (FIGS. 3D-3G), such as a trombone phase shifter or a sliding dielectric phase shifter. In particular, a phase-error compensation component 265 may provide phase-error compensation at an input to a non-rotational phase shifter 365. For example, a dielectric trombone line may be used instead of the rotating dielectric structure 265-D to provide the phase-error compensation.

Figure 3D:
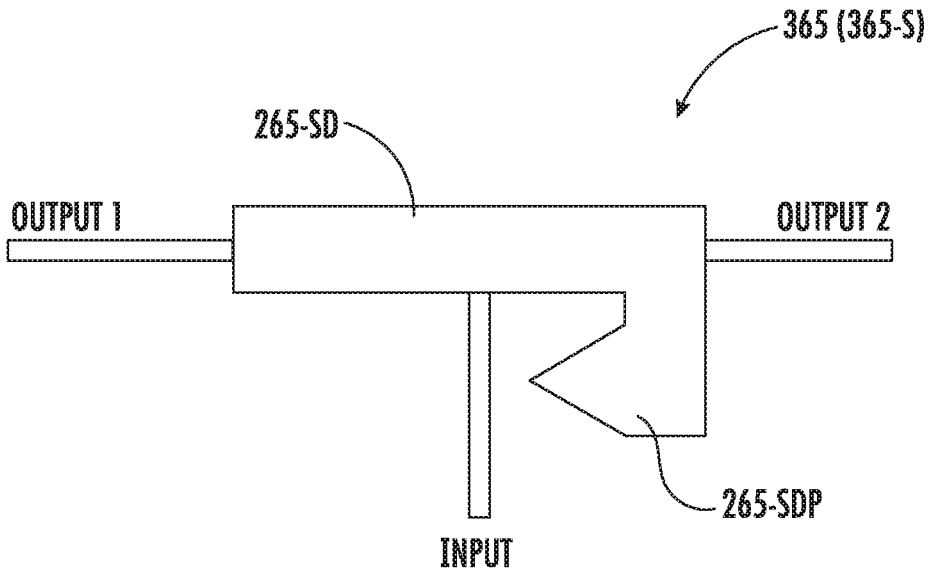
FIGS. 3D and 3E are schematic plan views of a sliding dielectric phase shifter having phase-error compensation, according to embodiments of the present inventive concepts.
Figure 3E:
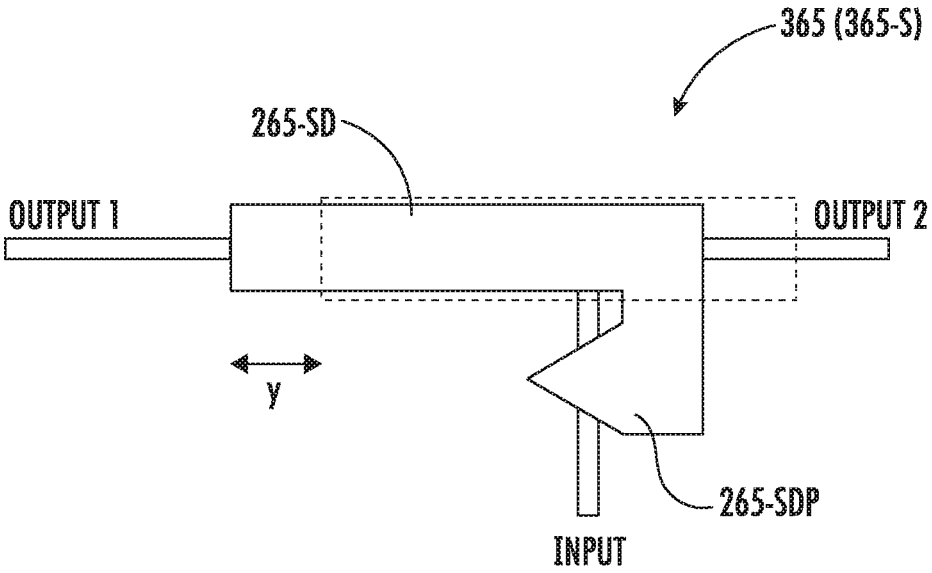

FIGS. 3D and 3E are schematic plan views of a sliding dielectric phase shifter 365-S having phase-error compensation, according to embodiments of the present inventive concepts. As shown in FIGS. 3D and 3E, a dielectric body 265-SD of the phase shifter 365-S slides left by a distance of y to create a phase delay at output 1 relative to output 2 of the phase shifter 365-S. This steers the antenna beam up or down, depending on the particular implementation. Moreover, the dielectric body 265-SD may include a portion (e.g., a wedge) 265-SDP of dielectric that is simultaneously inserted over (or under) the input line of the phase shifter 365-S to provide phase compensation (i.e., an adjustment to the phase delay) as the dielectric body 265-SD slides by the distance of y.

Figure 3F:
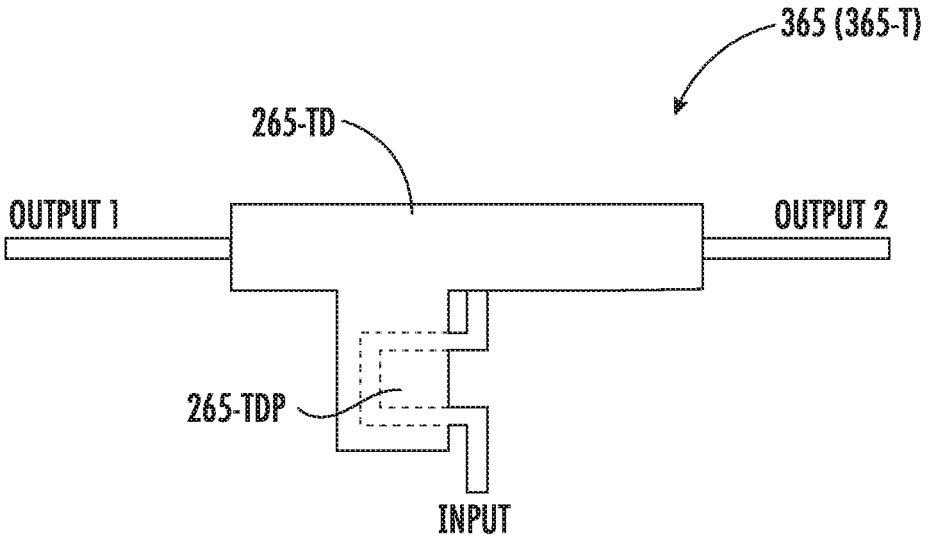
FIGS. 3F and 3G are schematic plan views of a trombone phase shifter having phase-error compensation, according to embodiments of the present inventive concepts.
Figure 3G:
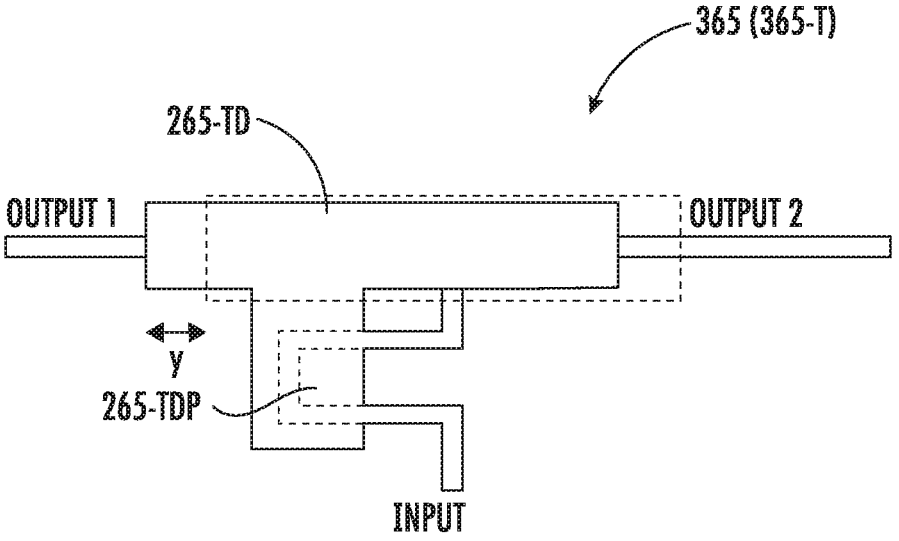

FIGS. 3F and 3G are schematic plan views of a trombone phase shifter 365-T having phase-error compensation, according to embodiments of the present inventive concepts. As shown in FIGS. 3F and 3G, a dielectric body 265-TD of the phase shifter 365-T slides left by a distance of y to create a phase delay at output 1 relative to output 2 of the phase shifter 365-T. Moreover, a portion 265-TDP of the dielectric body 265-TD (e.g., a dielectric trombone line) may move on, and along with, a movable portion of the input line of the phase shifter 365-T to provide phase compensation (i.e., an adjustment to the phase delay) as the dielectric body 265-TD slides by the distance of y.

Figure 4A:
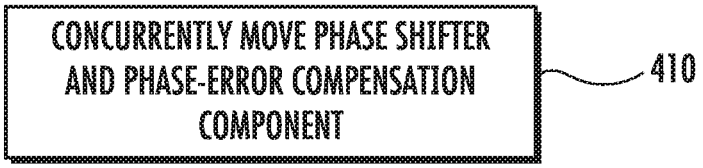
FIGS. 4A-4C are flowcharts illustrating operations of a base station antenna, according to embodiments of the present inventive concepts.
Figure 4B:
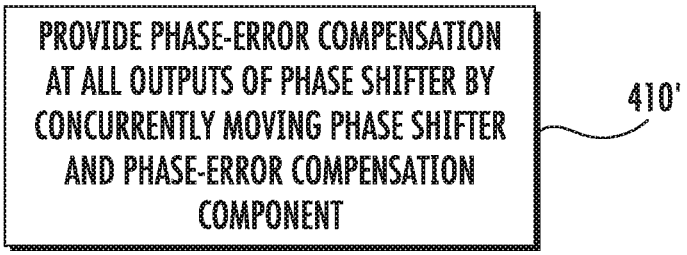
Figure 4C:
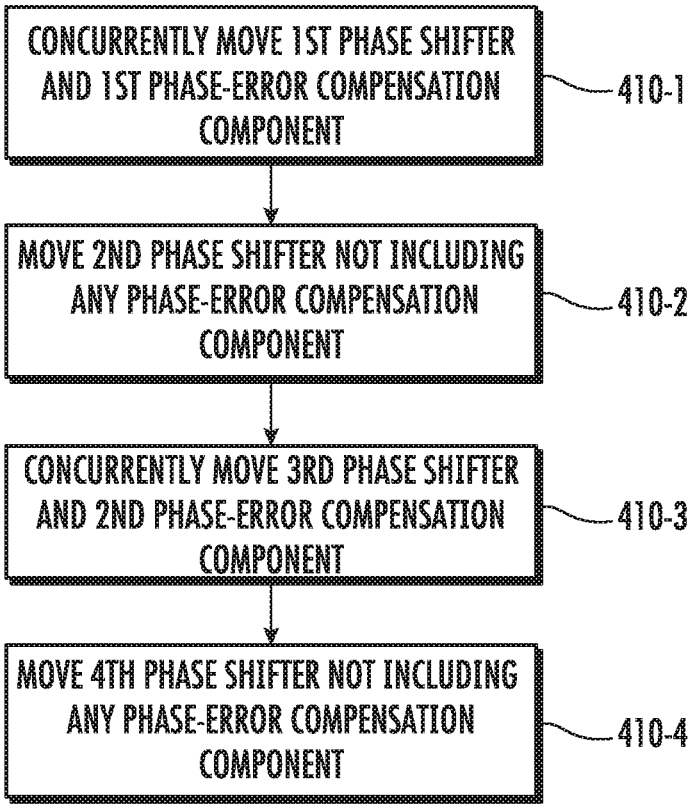

FIGS. 4A-4C are flowcharts illustrating operations of a base station antenna 100 (FIG. 1). As shown in FIG. 4A, an actuator 270 (FIGS. 2C-2E) of the antenna 100 may control an amount of multiple phase shifts (i.e., phase taper) that provide an electrical down-tilt and an amount of phase-error compensation (i.e., an adjustment to the phase shifts) for a vertical column of radiating elements 250 (FIG. 2A) by concurrently moving (Block 410) a movable element of a phase shifter 260 (FIGS. 2C-3C) and a phase-error compensation component 265 (FIGS. 2C-3C). Moreover, as shown in FIG. 4B, concurrently moving the phase shifter 260 and the phase-error compensation component 265 may, in some embodiments, provide (Block 410') phase-error compensation at all outputs of the phase shifter 260. This is because changing the phase at an input of the phase shifter 260 may impact all outputs of the phase shifter 260.

As shown in FIG. 4C, the antenna 100 may perform phase-error compensated phase shifting by moving (under the control of one or more actuators 270) a plurality of phase-error compensation components 265 along with corresponding phase shifters 260. For example, an actuator 270 may concurrently move (Block 410-1) a phase shifter 260-1 (FIG. 2C) and a phase-error compensation component 265-1 (FIG. 2C). The same actuator 270, or a different actuator 270, may concurrently move (Block 410-3) a phase shifter 260-3 (FIG. 2C) and a phase-error compensation component 265-3 (FIG. 2C). Moreover, the same actuator 270, or a different actuator 270, may move (Block 410-2) a phase shifter 260-2 (FIG. 2C) that does not include any phase-error compensation component 265. The same actuator 270, or a different actuator 270, may move (Block 410-4) a phase shifter 260-4 (FIG. 2C) that does not include any phase-error compensation component 265. The operations of Blocks 410-1 through 410-4 may be performed concurrently or sequentially.

The operations of Blocks 410-1 and 410-3 may be performed for any pair of non-consecutive ones of the vertical columns 250-1C through 250-4C. For example, the operations of Blocks 410-1 and 410-3 may be performed for vertical columns 250-1C and 250-3C, respectively, as shown in FIG. 2C, or for vertical columns 250-2C and 250-4C, respectively, as shown in FIG. 2I). Similarly, the operations of Blocks 410-2 and 410-4 may be performed for vertical columns 250-2C and 250-4C, respectively, as shown in FIG. 2C, or for vertical columns 250-1C and 250-3C, respectively, as shown in FIG. 2D.

An antenna 100 (FIG. 1) comprising a phase-error compensation component 265 (FIGS. 2C-3C) according to embodiments of the present inventive concepts may provide a number of advantages. These advantages include providing phase-error compensation at the input to a phase shifter 260 (FIGS. 2C-3C) based on movement of the phase-error compensation component 265. For example, an actuator 270 (FIGS. 2C-2E) may control an amount of phase-error compensation by the same mechanical movement that the actuator 270 uses to control the phase shifts of the phase shifter 260. The phase shifter 260 thus does not need to rely on software that uses a numerical value of down-tilt to calculate an amount of phase-error compensation for the phase shifter 260 to apply. Accordingly, down-tilt can be compensated for by mechanical movement of the actuator 270 while ignoring a particular down-tilt setting (e.g., angle) of the antenna 100.

The compensation described herein is substantial, but not necessarily total. For example, the phase-error compensation component 265 may add at least 50-70% phase-error compensation at an input of the phase shifter 260. This level of compensation may be sufficient for an antenna assembly 200 (FIG. 2A) having staggered vertical columns 250-1C through 250-4C, which staggering may advantageously reduce mutual coupling between the columns 250-1C through 250-4C.

Moreover, half of the staggered columns 250-1C through 250-4C may not be phase-error compensated, and their respective phase shifters 260 may thus not include any phase-error compensation component 265. An azimuth pattern will scan along a line parallel to center points 251 of horizontally-adjacent radiating elements 250 (FIG. 2A). Vertical staggering, however, can undesirably result in scanning at an angle, which may then result in a phase error because phase centers of consecutive ones of the staggered columns 250-1C through 250-4C are not the same. Adding phase-error compensation to every other one of the columns 250-1C through 250-4C may substantially mitigate the phase error, and it thus may not be necessary to add phase-error compensation to every one of the columns 250-1C through 250-4C. Rather, phase-error compensation may be omitted for odd-numbered, or even-numbered, ones of the columns 250-1C through 250-4C. For each column that is phase-error compensated, all outputs of a corresponding phase shifter 260 may, in some embodiments, have an additional phase shift (e.g., a phase delay) due to a phase-error compensation component 265.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A base station antenna comprising:

vertically staggered consecutive first, second, third, and fourth vertical columns of radiating elements that are configured to transmit radio frequency (RF) signals in a frequency band;

a phase shifter that is electrically connected to the first vertical column of radiating elements or the second vertical column of radiating elements; and a phase-error compensation component that is configured to provide phase-error compensation at an input to the phase shifter based on movement of the phase-error compensation component, wherein the phase shifter comprises a wiper phase shifter, wherein a rotatable portion of the wiper phase shifter comprises a wiper Printed Circuit Board (PCB), and wherein the phase-error compensation component comprises a dielectric structure that is between the wiper PCB and a main PCB of the wiper phase shifter.

2. The base station antenna of claim 1, further comprising a mechanical actuator that is configured to concurrently control the movement of the phase-error compensation component and movement of the phase shifter.

3. The base station antenna of claim 1, wherein the dielectric structure is attached to the wiper PCB.

4. The base station antenna of claim 1, wherein the phase shifter and the phase-error compensation component comprise a first phase shifter and a first phase-error compensation component, respectively, and wherein the base station antenna further comprises:

a second phase shifter that is electrically connected to the third vertical column of radiating elements or the fourth vertical column of radiating elements; and a second phase-error compensation component that is configured to provide phase-error compensation at an input to the second phase shifter based on movement of the second phase-error compensation component.

5. The base station antenna of claim 4, wherein the first and second phase shifters are electrically connected to the first and third vertical columns of radiating elements, respectively, wherein the base station antenna further comprises third and fourth phase shifters that are electrically connected to the second and fourth vertical columns of radiating elements, respectively, and wherein each of the third and fourth phase shifters does not include any movable phase- error compensation component.

6. The base station antenna of claim 4, wherein the first and second phase shifters are electrically connected to the second and fourth vertical columns of radiating elements, respectively, and wherein the base station antenna further comprises third and fourth phase shifters that are electrically connected to the first and third vertical columns of radiating elements, respectively, and wherein each of the third and fourth phase shifters does not include any movable phase- error compensation component.

7. The base station antenna of claim 1, wherein the base station antenna is configured to operate in a beam-forming mode.

8. The base station antenna of claim 1, wherein the input to the phase shifter comprises an input RF transmission line of the phase shifter, and wherein a phase delay of phases traversing the input RF transmission line of the phase shifter changes as the phase-error compensation component moves relative to the input RF transmission line of the phase shifter.

9. A base station antenna comprising:

consecutive first, second, and third vertical columns of radiating elements that are configured to transmit radio frequency (RF) signals in a beam-forming mode;

a phase shifter that is electrically connected to the first vertical column of radiating elements or the second vertical column of radiating elements; and a phase-error compensation component that is configured to provide phase-error compensation at an input to the phase shifter based on movement of the phase-error compensation component, wherein the phase shifter comprises a movable dielectric body, and wherein the phase-error compensation component extends from the movable dielectric body of the phase shifter.

10. The base station antenna of claim 9, wherein the second vertical column of radiating elements is vertically staggered relative to the first and third vertical columns of radiating elements.

11. The base station antenna of claim 10, further comprising a fourth vertical column of radiating elements that is vertically staggered relative to the first and third vertical columns of radiating elements and configured to transmit RF signals in the beam- forming mode, wherein the fourth vertical column of radiating elements is adjacent the first vertical column of radiating elements or the third vertical column of radiating elements.

12. The base station antenna of claim 9, further comprising a mechanical actuator that is configured to concurrently control the movement of the phase-error compensation component and movement of the phase shifter.

13. The base station antenna of claim 12, wherein the phase shifter is configured to provide an amount of phase-error compensation at all outputs of the phase shifter in response to the phase-error compensation.

14. A method of operating a base station antenna, the method comprising controlling an amount of phase shift and an amount of phase-error compensation for a vertical column of radiating elements by concurrently moving a phase shifter and a phase-error compensation component, wherein the phase shifter comprises:

a non-rotational phase shifter comprising a movable dielectric body from which the phase-error compensation component extends; or a wiper phase shifter comprising a wiper Printed Circuit Board (PCB) and a main PCB having the phase-error compensation component therebetween.

15. The method of claim 14, wherein the controlling is performed by a mechanical actuator of the base station antenna.

16. The method of claim 14, wherein the controlling comprises providing the amount of phase-error compensation at all outputs of the phase shifter, wherein the phase shifter, the vertical column of radiating elements, and the phase-error compensation component comprise a first phase shifter, a first vertical column of radiating elements, and a first phase-error compensation component, respectively, wherein the method further comprises controlling an amount of phase shift and an amount of phase-error compensation for a second vertical column of radiating elements by concurrently moving a second phase shifter and a second phase-error compensation component, wherein the first and second vertical columns of radiating elements are vertically staggered relative to an adjacent third vertical column of radiating elements and are configured to transmit radio frequency (RF) signals in a beam-forming frequency band, and wherein the method further comprises controlling an amount of phase shift for the third vertical column of radiating elements by moving a third phase shifter while the third phase shifter does not include any movable phase-error compensation component.

17. The base station antenna of claim 9, wherein the phase-error compensation component is a protruding portion of the movable dielectric body of the phase shifter, and wherein the phase shifter comprises a non-rotational phase shifter.

18. The base station antenna of claim 17, wherein the non-rotational phase shifter comprises a trombone phase shifter or a sliding dielectric phase shifter.

19. The method of claim 14, wherein the non-rotational phase shifter comprises a trombone phase shifter or a sliding dielectric phase shifter.

20. The method of claim 14, wherein the phase-error compensation component comprises a dielectric structure that is between the wiper PCB and the main PCB.

* * * * *